United States Patent [19]

Spiegelman et al.

[11] Patent Number: 4,602,767

[45] Date of Patent: Jul. 29, 1986

[54] THERMOCOUPLE APPARATUS FOR IN SITU ANNEALING OF A PRESSURE VESSEL

[75] Inventors: Stanley R. Spiegelman, Pittsburgh; Phillip E. Miller, Greensburg; Robert Shaffer, Pittsburgh, all of Pa.

[73] Assignee: Westinghouse Electric Corp., Pittsburgh, Pa.

[21] Appl. No.: 623,591

[22] Filed: Jun. 22, 1984

[51] Int. Cl.[4] ..... C21D 11/00

[52] U.S. Cl. ..... 266/87; 266/249; 266/287

[58] Field of Search ..... 266/249, 78, 287, 87, 266/88; 136/221

[56] References Cited

U.S. PATENT DOCUMENTS

| | | | |
|---|---|---|---|
| 1,668,678 | 5/1928 | Hassinger | 219/203 |
| 2,834,860 | 5/1958 | Claiborne et al. | 219/469 |
| 2,839,594 | 6/1958 | Schneidersmann | 136/221 |
| 2,973,397 | 2/1961 | Halstead | 136/221 |
| 2,988,582 | 6/1961 | McGregor et al. | 136/221 |
| 3,080,968 | 5/1963 | Wuczkowski | 266/87 |
| 3,516,873 | 6/1970 | Bonkowski | 136/221 |
| 3,751,305 | 8/1973 | Huebscher | 136/221 |
| 4,305,286 | 12/1981 | Beuth et al. | 73/343 B |
| 4,394,562 | 7/1983 | Epstein et al. | 219/306 |
| 4,410,756 | 10/1983 | Schwagerman | 136/221 |

FOREIGN PATENT DOCUMENTS

| | | | |
|---|---|---|---|
| 243856 | 1/1963 | Australia | 136/221 |
| 596931 | 4/1960 | Canada | 136/221 |
| 765381 | 9/1980 | Japan | 148/155 |

*Primary Examiner*—Christopher W. Brody
*Attorney, Agent, or Firm*—Daniel C. Abeles

[57] ABSTRACT

Two sets of heater support members angularly distributed around a central vertical member are radially extendable individually or in groups to position heater elements within a preset distance of the cylindrical walls of any one of a series of pressure vessels having a range of diameters. A convex bottom heater support member is provided for each diameter vessel and is axially telescoped into the central vertical member so that an additional set of heater support members can be installed between the first mentioned two sets of heater support members and the bottom heater support member to accommodate for varying depths of the vessels in the series. Thermocouples are extended from the annealing device by actuators which use a spring or pneumatic pressure to press the thermocouple against the vessel wall with a preset constant force for accurate temperature measurements. The actuators use pneumatic pressure to retract the thermocouples to preclude damage during withdrawal of the annealing device from the vessel.

8 Claims, 10 Drawing Figures

129
115
115
115
107
93
91
91
91
107
109
117
115
111
97
93
99
113
103
101
33
121
105
127
123
105
91
95
TRAVEL 107
137
141
139
97'
133
93'
99'
135
103'
101'
113'
115
33
123'
131
105'
91
95
TRAVEL

THERMOCOUPLE APPARATUS FOR IN SITU ANNEALING OF A PRESSURE VESSEL

BACKGROUND OF THE INVENTION

1. Field of the Invention

This invention relates to apparatus for annealing cylindrical vessels in situ by applying heat to the internal surface of the vessel, and more particularly, it applies to apparatus which is adjustable to accommodate vessels of various diameters and depths and which incorporates extendable and retractable thermocouple devices for monitoring vessel temperature during the annealing process.

2. Prior Art

Large pressure vessels such as those used to contain the cores of nuclear reactors are fabricated from steel plate sections which are welded together. These vessels are generally right cylindrical containers with an integral convex bottom, a radial flange around the top to which a separate cover is bolted, and inlet and outlet nozzles welded to openings in the cylindrical sides walls. Stresses created during fabrication are relieved by an annealing process carried out in a large oven.

It has been discovered that after prolonged exposure to the gamma rays produced by operation of the reactor, the vessel welds can become brittle. It has also been determined that annealing will restore the ductility of these welds, however, in order to avoid the creation of additional stresses, the entire vessel, not just the welds, must be brought to the annealing temperature. While this could be accomplished by placing the vessel in an annealing oven as during manufacture, it is just not practical to remove the now radioactive vessel from the ship or containment in which it is installed for annealing in an oven. It is preferable to anneal the vessel in situ, although this creates its own set of difficulties. Foremost among these is the fact that, since the surroundings in which the reactor vessel is installed, whether in a ship or a fixed installation, restrict access to the outside of the vessel, the heat for in situ annealing of the vessel must be applied solely from the interior of the vessel.

In one installation in which in situ annealing of a reactor vessel was carried out, a fixture having the general configuration of the cylindrical side walls and convex bottom of the vessel was suspended in the vessel. This fixture included axially adjacent rings extending along the cylindrical portion of the vessel each divided into four arcuate panels and a convex panel forming the bottom section. Each panel supported electric resistance heater wires arranged in a pattern to create a heating zone which provided a uniform watt density over the adjacent portion of the interior surface of the vessel. At the thicker portions of the vessel, such as at the flange along the upper edge and at the nozzles, the watt density was increased so that the entire vessel could be brought to a uniform annealing temperature, in the neighborhood of 1000° Fahrenheit.

The watt density generated by each resistance heater was controlled by a system which included termocouples to measure the actual temperature of the vessel at each heating zone. Reliable measurement of the vessel temperature required that the junctions of the termocouples be pressed against the interior wall of the vessel with a predetermined force. Once the fixture was lowered into position, thermocouples were extended to contact the vessel wall by pushing them through conduit extending vertically downward, and for the side walls, curving radially outward. Some difficulty was encountered in applying the desired force to the thermocouples bearing against the side walls due to friction and binding of the thermocouple lead in the conduit.

While this apparatus was satisfactory for annealing vessels of the same size, reactor vessels vary in diameter and depth. A primary object of the present invention is to provide apparatus which can be easily adjusted for annealing a series of vessels having a range of sizes and to provide means for maintaining the thermocouples in contact with the vessel walls with a predictable preset force so that accurate temperature measurements can be taken during the annealing process.

SUMMARY OF THE INVENTION

In accordance with the invention, any one of a series of pressure vessels which vary in diameter is annealed in situ by apparatus which includes a support structure which is extended downward into the vessel. A set of heater support members angularly arranged around the support structure are radially extendable to within a preset distance of the cylindrical inner side walls of the vessel. The number of heater support members in the set is chosen so that when they are extended to accommodate the vessel of largest diameter, the angular gap between them is limited so that heater elements mounted on the supports can generate a generally uniform watt density in the vessel wall adjacent to the gaps. This set of heater support members can be divided into two axially displaced sets which are interconnected vertically for simultaneous radial extension and retraction. A selected one of a series of bottom heater support members, which includes one for each diameter vessel, is secured to the bottom of the support structure. Each such bottom heater support member has a convex bottom surface which supports a pattern of heaters a preset distance from the concave inner bottom surface of the vessel.

To accommodate vessels of varying depth, an additional set of heater support members can be mounted on the support structure. Since preferably the apparatus is suspended in the vessel from a horizontal support plate which rests on the vessel top flange and forms a seal therewith, the bottom heater support members are telescopically connected to the support structure and the additional set of heater support members are mounted between the first mentioned heater support members and the bottom heater support member which is extended axially to position its heater elements the preset distance from the bottom of the deeper vessel.

Apparatus is mounted in the heater support members for supporting thermocouples for extension to bear against the walls of the vessel with preset force to measure the temperature of the vessel during annealing and for retraction when the unit is to be removed from the vessel. This apparatus includes a cylinder with a bore through which the thermocouple extends and a piston slideable in the bore and to which the thermocouple is secured for extension and retraction with the piston. A sliding seal between the thermocouple and the cylinder forms with the piston a closed chamber of variable volume. Fluid pressure in the chamber controls movement of the piston and therefore the thermocouple. In one embodiment of the invention, positive pressure in the chamber extends the thermocouple and negative pressure retracts it. By using a common supply of pressurized fluid a uniform force can be applied to the piston associated with each of the thermocouples. In another embodiment, a compression spring maintains the preset force on the extended thermocouple and positive fluid pressure is used to retract the thermocouple against the spring bias.

BRIEF DESCRIPTION OF THE DRAWINGS

A full understanding of the invention can be gained from the following description read in conjunction with the accompanying drawings in which.

DESCRIPTION OF THE PREFERRED EMBODIMENTS

Figure 1:
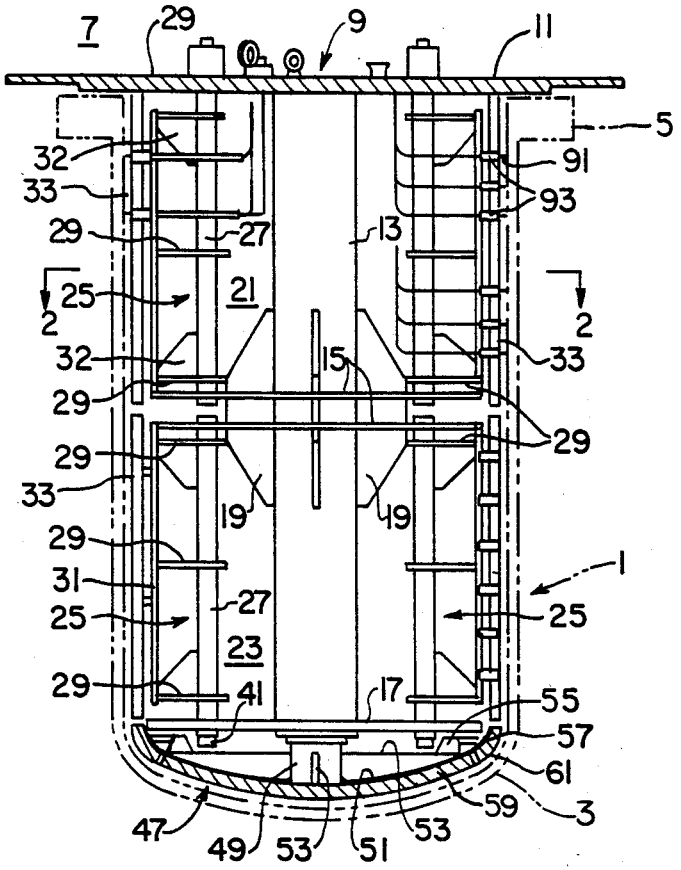
FIG. 1 is a vertical sectional view through apparatus in accordance with the teachings of the invention shown in the retracted condition for use in annealing the pressure vessel of smallest diameter and smallest depth in a series of pressure vessels having a range of diameters and depths.

The present invention is directed to apparatus used to anneal in situ pressure vessels which may vary in diameter and in depth and will be described as applied to annealing nuclear reactor vessels while they remain in the ship or containment in which they are installed. FIG. 1 illustrates in phantom line such a reactor vessel 1 which is typically a cylindrical container witha convex ellipsoid bottom 3 and a flange around the top to which the vessel cover (not shown) is secured. With the vessel cover removed, the annealing device 7 of this invention is lowered into the empty vessel 1.

The annealing device 7 includes a support structure 9 comprising horizontal support plate 11 which rests on the flange 5 of the vessel, a tubular central support 13 which depends from the support plate 11, a pair of horizontal plate members 15 extending radially outward from the middle of the central support 13, and a bottom horizontal plate member 17. Orthogonally disposed longitudinal plates 19 welded to the central support 13 and plates 15 provide stiffening for the structure.

Mounted on the support structure 9 are two axially displaced sets 21 and 23 of heater support members 25. Each heater support member includes a tubular hardback 27, and radial supports 29 extending outward from the top, bottom and middle of the hardback which support at their radial extremeties an arcuate plate 31. The top and bottom radial supports 29 are stiffeneed by plates 32. Mounted on the arcuate plate 31 is an arcuate heater panel 33 which is described in more detail below.

Figure 4:
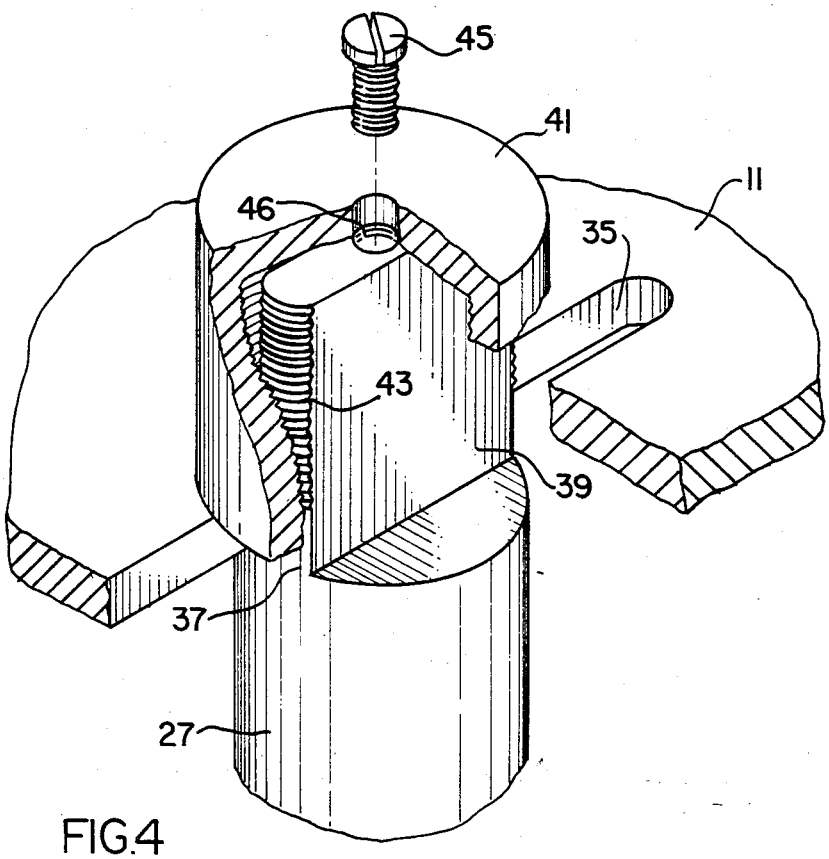
FIG. 4 is an enlarged isometric view with some parts broken away of a portion of the apparatus of FIG. 1 illustrating the mechanism which permits the apparatus to be expanded and retracted radially.

Each set 21 and 23 of heater support members 25 is mounted for radial extension and retraction relative to the support structure 9. Those in set 21 are mounted between horizontal support plate 11 and the upper horizontal plate 15 while those in set 23 are mounted between the lower horizontal plate 15 and bottom horizontal plate 17. These horizontal plates all have angularly spaced, radial slots 35 equal in number to the number of heater support members 25 in the associated set (see FIG. 2). As best seen in FIG. 4, each end of the hardback 27 of each heater support member 25 has a tongue 37 which extends through an associated slot 35. The flat sides 39 on each tongue prevent rotation of the hardback and therefore limit movement of the heater support member 25 to radial translation. An internally threaded cap 41 screws down onto threads 43 on the radial ends of the tongue 37 to clamp the hardback to the plate 11, 15 or 17. A locking bolt 45 is received in a threaded bore 46 in the end of the tongue 37 to prevent the cap 41 from backing off.

Figure 2:
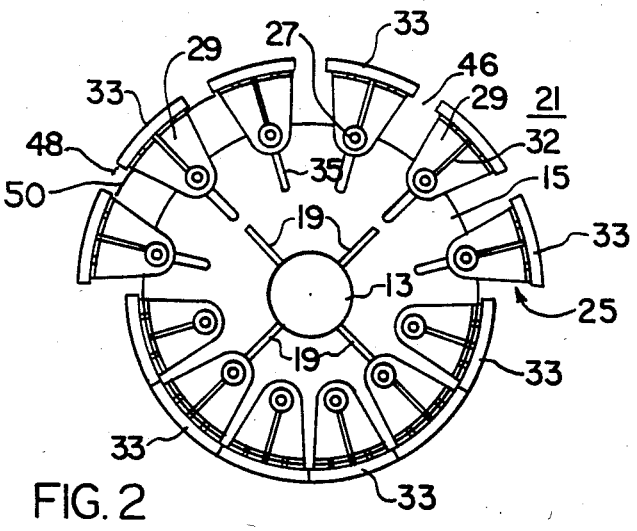
FIG. 2 is a horizontal sectional view through the apparatus of FIG. 1 taken along the line 2—2.

FIG. 2 illustrates the upper set 21 of support members 25 with those in the lower half of the figure shown in the retracted position and those in the upper half shown in the extended position. This is for illustrative purposes only and in use, all of the heater support members would be set at the same radial position determined by the internal diameter of the vessel to be annealed. As can be appreciated from FIG. 2, when the heater support members are retracted, the heater panels mounted on them form a substantially continuous cylindrical surface. When the heater support members 25 are extended, axially extending gaps 48 appear between adjacent heater panels. The limit on the size of these gaps 48 which is determined by the number of heater support members in the set which in turn is dependent upon the difference between the diameters of the smallest and largest vessel to be annealed by the apparatus are discussed more fully below. Every other heater support member 25 is provided on each side with an arcuate seal 50 which bridges the gap between heater support members to block convection currents that would otherwise be set up in the shielding water during the annealing process.

A bottom heater support member 47 includes a tubular stem 49, a circular convex support panel 51 stiffened by four radially extending plates 53 and radial extension 55 supporting an annular support 57. Mounted on the support panel 51 is a circular heater panel 59 having a convex surface which is parallel to the convex inner surface of the bottom 3 of the vessel being annealed. An annular, axially curved heater panel 61 which conforms to the radius of the vessel inner wall at the intersection of the cylindrical side walls and the circular convex bottom wall is mounted on the annular support 57. The tubular stem 49 telescopes into the central tubular support 13 to secure the bottom heater support member 47 to the support structure 9.

Figure 3:
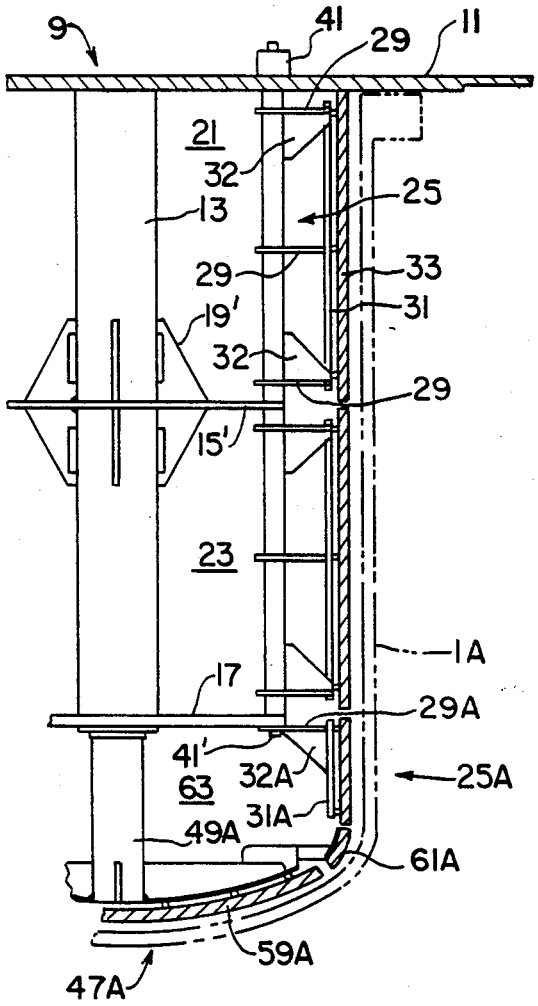
FIG. 3 is a partial vertical sectional view through modified apparatus similar to that in FIG. 1 shown in the expanded condition for use in annealing the pressure vessel of largest diameter and greatest depth in the series of pressure vessels.

FIG. 3 illustrates the apparatus extended to accommodate the largest vessel 1A in the series of vessels to be annealed. The structure of FIG. 3 is modified slightly from that in FIG. 1 to illustrate an alternate arrangement for supporting the heater support members 25, otherwise the two devices operate in the same manner to anneal vessels of varying size. The difference in the device of FIG. 3 is that the vertically aligned heater support members 25 in the upper and lower sets 21 and 23 are mounted on a common hardback 27' which is supported intermediate to the two sets of heater support members by a single horizontal plate 15', so that corresponding heater support members in each set are positioned radially as a unit. In any event, FIG. 3 shows the heater support members radially extended to fit the vessel having the largest diameter in the series of vessels to be annealed. The bottom heater support member 47 is replaced by another bottom member 47A which carries a circular convex heater panel 59A which conforms to the convex inner bottom surface of the larger vessel an an axially curved annular heater panel 61A which matches the intersection of the side and bottom walls of the largest vessel. A series of bottom heater support members 47 are provided, one for each diameter of the vessels to be annealed.

The device of FIG. 3 has also been expanded to accommodate a vessel 1 of greater depth than that shown in FIG. 1. The extra depth is obtained by axially extending the tubular stem 49A to locate the bottom heater panel 59A the preset distance from the inner bottom wall of the vessel and by providing an additional set 63 of heater support members 25A in the axial gap thus generated between the bottom heater support member 47A and the lower set 23 of heater support members 25. The additional heater support members 25A include a radial support 29A supporting an arcuate plate 31A and stiffened by radially extending plate 32A. A heater panel 33A mounted on arcuate panel 31A provides continuous heater coverage over the inner wall surface of the vessel. The additional set 63 of heater support members are clamped to the bottom horizontal plate 17 by the cap 41' which also clamps the bottom of hardback 27' and thus can be radially adjusted with the heater support members of sets 21 and 23 to anneal other vessels of the same depth, but varying diameter. For vessels of other depths greater than the minimum depth, other additional sets of heater support members can be secured to the bottom horizontal support plate 17 in place of set 63. Adding the additional sets of heater support members required for the deeper vessels below the sets 21 and 23 permits the annealing device to be supported by the horizontal support plate 11 resting on the vessel top flange 5 for all size vessels while also providing a seal so that a vacuum can be maintained in the vessel to contain the contaminants and to improve the heat transfer characteristics.

Figure 5:
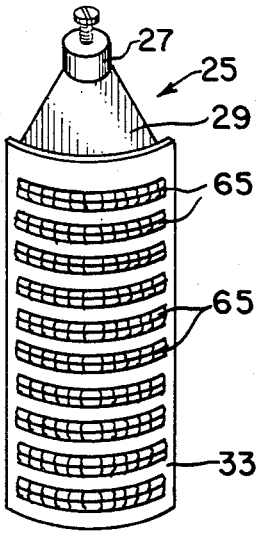
FIG. 5 is an isometric view of one of the heater support members illustrating the pattern of heater elements.

FIG. 5 shows one of the heater panels 33 as mounted on a heater support member 25. The heater elements 65 are double strands of spiral 80% nickel 20% chrome nickel-chromium heater wire threaded through ceramic beads in a conventional manner to provide a larger effective heat source and support for the heater wire. The heater elements 65 are arranged on the heater panel in an array which generates a substantially uniform radiation pattern. Either wire of the double strand in each heater element is capable of providing the required heat density with the second wire being redundant to assure even heating should the primary wire fail.

As mentioned in connection with FIG. 2, radial extension of the heater support members 25 creates longitudinal gaps 48 between the heater panels 33. The angular size of these gaps 48 is limited by the ability of the heater units to uniformly heat the vessel wall radially adjacent the gaps. Thus, each gap should be no larger than that across which the heaters can substantially uniformly heat the adjacent vessel wall, which to some extent is dependent upon the radial spacing between the heaters and the vessel wall. In any event, the limit on the angular width of the gap between heaters determines how many heater support members 25 there must be in a set. While the difference in the circumference of the inner vessel wall for vessels of two different diameters is fixed, and therefore the total gap space between heater support members expanded to the larger diameter is constant, the number of support members determines the number of discrete gaps and therefore the angular size of each gap. Thus, the larger the difference in the diameters of two vessels, the more heater support members are required to keep the gap 48 between heater elements within the limit. As a specific example, a unit made to anneal a series of vessels having a minimum diameter of 66.0 inches and a maximum diameter of 84.0 inches was provided with 12 heater support members which created gaps 4.38 inches in peripheral length when extended to within 4.0 inches of the largest diameter vessel.

If only the larger diameters vessels are deeper, it is not necessary that the additional set of heater support members 63 include as many individual support members. Clearly, if the greatest depth is only associated with the vessel of largest diameter, the additional set of heater support members that service that length vessel would not have to be radially adjustable at all, and even one annular support member could be used although it may be more manageable to make it in sections.

Figure 6:
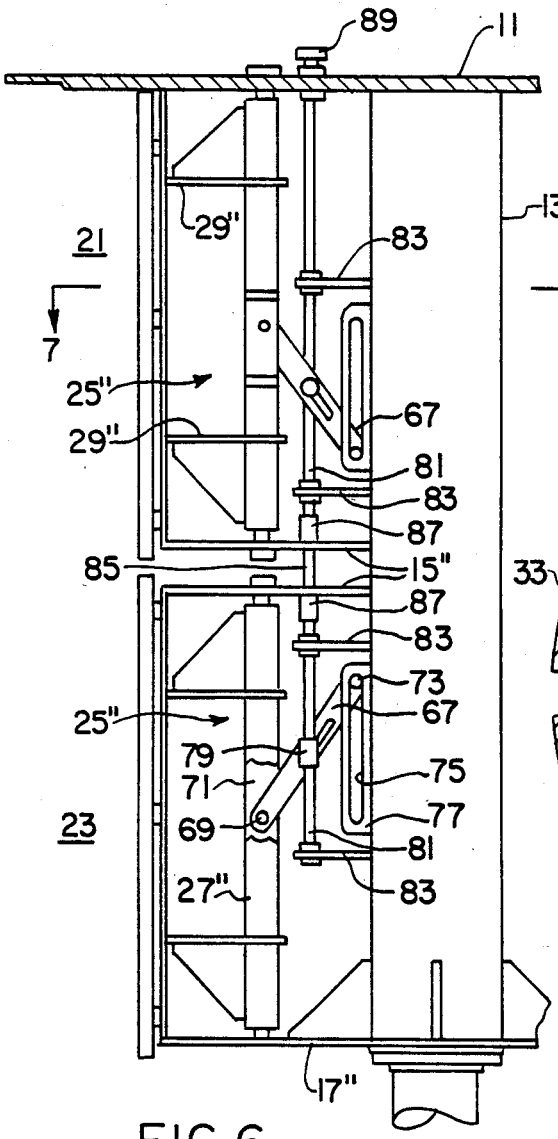
FIG. 6 is a partial vertical section through a second embodiment of the invention in which the upper and lower sets of heater support members are adjusted simultaneously from the top of the apparatus.
Figure 7:
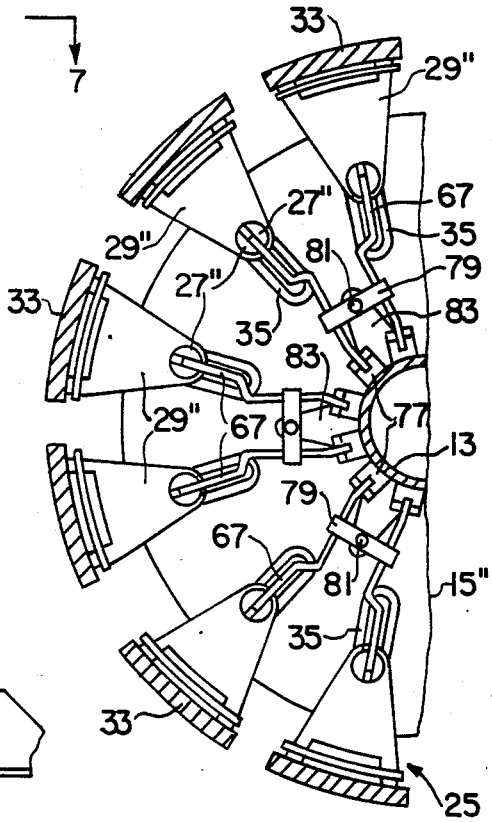
FIG. 7 is a sectional view through the apparatus of FIG. 6 taken along the line 7—7 with some parts removed for clarity.

FIGS. 6 and 7 show a modified form of the annealing device in which the positions of the top and bottom sets 21 and 23 of heater support members 25" can be radially adjusted from above the horizontal support plate 11. In this arrangement, a lever arm 67 is pivotally secured at one end to each hardback 27" by a pin 69 through a slot 71. The other end of each lever arm 67 is pivotally secured by a pin 73 which slides in elongated vertical slots 75 in a clevis 77 secured to the tubular central support 13. An intermediate point on each level arm 67 is pivotally connected to a trunnion nut 79 which engages a threaded shaft 81. Each threaded shaft 81 is supported for rotation by brackets 83 welded to the tubular central support 13. The vertically aligned threaded shafts are connected by an intermediate shaft 85 journaled in horizontal plates 15" and universal joints 87. The upper threaded shaft 81 is journaled at its upper end in horizontal support plate 11 and terminates in a coupling 89 in which a crank can be inserted. Rotation of the shafts 81 causes the trunnion nuts 79 to translate along the shafts resulting in rotation of the lever arms 67 and extension or retraction of the heater support members 25" depending upon the direction of rotation.

As shown in FIG. 7, adjacent lever arms 67 are paired and bent angularly inward toward one another so that they are both connected to the same trunnion nut 79 on an extension and retraction mechanism and therefore only six such mechanisms are needed to operate the twelve heater support members 25" in each set.

Figures 8, 9, 10:
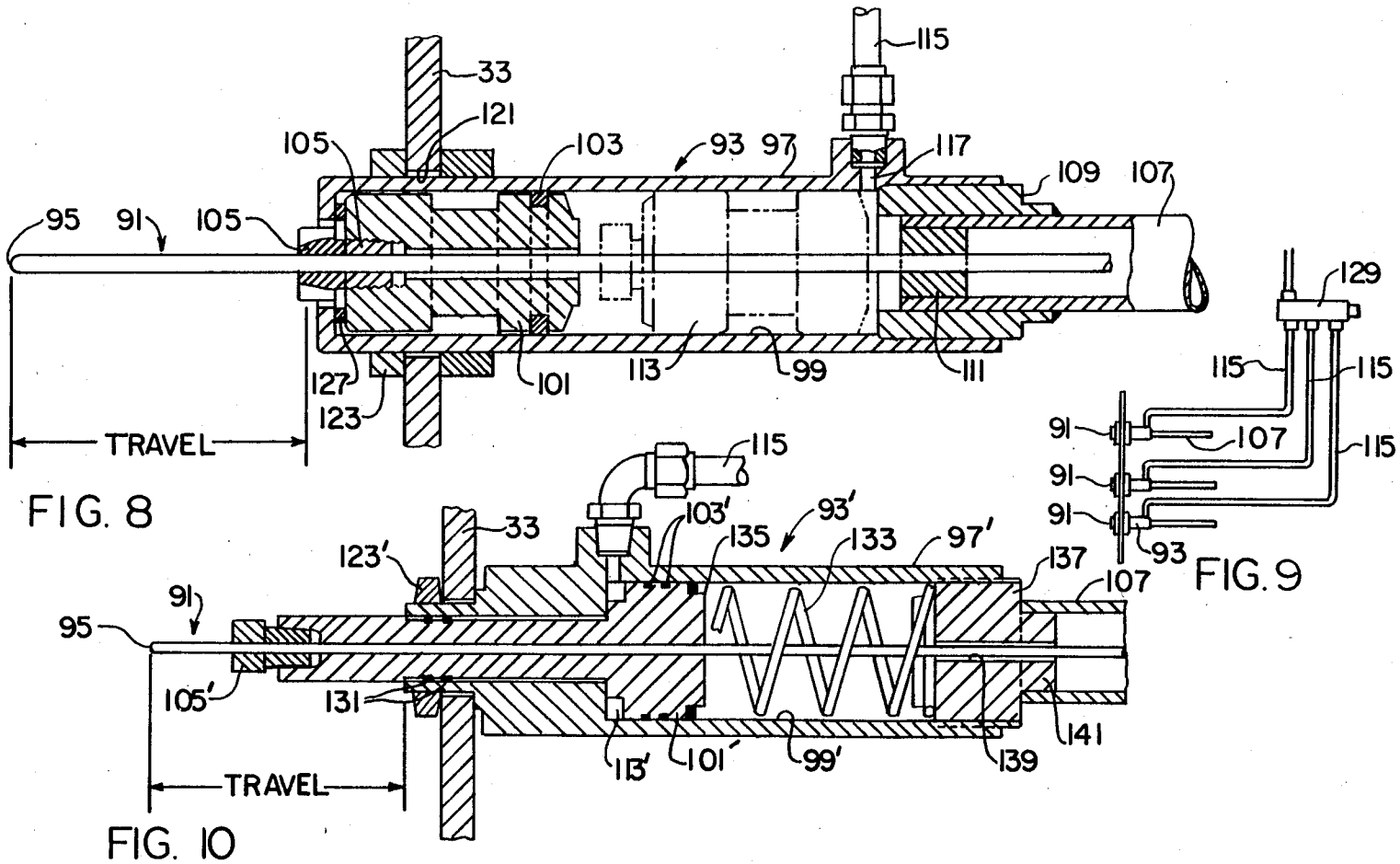
FIG. 8 is a vertical sectional view through one embodiment of an actuator for extending and retracting thermocouples used by the annealing devices of FIGS. 1–7.
FIG. 9 is a schematic illustration of the pneumatic circuit for the actuators shown in FIG. 8.
FIG. 10 is another embodiment of a thermocouple actuator in accordancd with the invention.

It is very important when annealing a reactor vessel that the temperature be accurately controlled which in turn requires that the vessel temperature be accurately measured. The temperature measurements are taken by thermocouples 91 which are supported by actuators 93 mounted in the heater panels 33. As shown in FIG. 8, the thermocouples 91 are 0.125 inch diameter stainless steel sheathed dual type sensors with the thermocouple junction at the tip 95 pressed against the vessel wall by actuator 93. The actuators 93 include a cylindrical body 97 having an axial bore 99. A piston 101 is slidably fitted in the axial bore 99 and sealed with a piston ring 103. The thermocouple 91 extends axially through the bore 99 and the piston 101 and is secured to and sealed with the piston 101 by a collet nut 103 which is threaded into a tapered bore 105 in the piston. A protective conduit 107 for the thermocouple 91 is sealed in the other end of bore 99 by a sleeve 109. A metallic seal 111 in the conduit provides a sliding seal for the thermocouple 91 to form with the piston 101 a variable volume chamber 113. A pneumatic line 115 supplied fluid pressure to the variable volume chamber 113 through inlet 117. At the end from which the thermocouple is extended, the cylindrical body 97 is threaded and provided with a shoulder 119 so that the actuator can be counted in bore 121 in heater panel 33 by a nut 123. A radially innerwardly extending flange 125 on the cylindrical body 97 prevents escape of the piston 101 from bore 99. If desired, a spacer 127 can provide a cushioned stop for the piston.

The thermocouple 91 activated by the device of FIG. 8 is extended by the introduction of fluid under positive pressure, such as compressed air, into the chamber 113 through line 115, causing the piston to move to the left until the tip 95 contacts the wall of the vessel, or in the case of the compensating thermocouples, the piston comes in contact with the spacer 127. As shown in FIG. 9, the pneumatic lines 115 are connected to a common manifold 129 so that the thermocouples touching the wall are pressed against the vessel wall with a uniform preset force which does not vary with temperture. This is important since thermocouple accuracy is closely related to contact force. The thermocouple is retracted by applying pressure to the chamber 113 below the ambient pressure in the vessel. This protects the thermocouples from damage as the annealing device is inserted and withdrawn from the vessel.

FIG. 10 illustrates an alternative embodiment 93' of the thermocouple actuator in which the piston 101' has an extension 101'' of reduced diameter on its outer end which slides within the smaller diameter portion 99'' of axial bore 99' to form the variable volume chamber 113' on the side of piston 101' adjacent the vessel wall. Piston rings 103' and 131 seal the ends of this chamber. The thermocouple 91 is secured to the piston by collet nut 105'. A compression spring 133 seats on a peripheral shoulder 135 on the piston 101' and bears against a threaded plug 137 screwed into the bore 99' to bias the piston forward and to therefore extend the thermocouple toward the vessel wall with the preset contact force. The thermocouple 91 slides freely through axial bore 139 in the plug 137 and the protective conduit 107 is secured to a collar 141 on the plug. The spring is chosen so as to apply the appropriate preset contact force to the thermocouple junction over the operating temperature range. Inconel X750 is a suitable material for the spring 133. The thermocouple 91 is retracted by introducing fluid at a positive pressure into the chamber 113' through line 115. This embodiment has the advantage that it is not necessary to maintain a constant fluid pressure during the annealing process.

The apparatus disclosed provides economical, easily adjusted means for annealing a series of vessels of varying diameter and depth and for maintaining constant contact pressure on remotely extendable and retractable thermocouples monitoring the temperature.

While specific embodiments of the invention have been described in detail, it will be appreciated by those skilled in the art that various modifications and alternatives to those details could be developed in light of the overall teachings of the disclosure Accordingly, the particular arrangement disclosed are meant to be illustrative only and not limiting as to the scope of the invention which is to be given the full breadth of the appended claims and any and all equivalent thereof.

What is claimed is:

1. Apparatus for extending a thermocouple axially toward and maintaining the junction on the end thereof in contact with the surface of an object to measure the temperature thereof and for retracting the thermocouple from said surface, said apparatus comprising:

a cylinder having a bore extending axially therethrough generally transverse to said surface;

a piston slidable in said bore and fixedly secured to said thermocouple which extends axially through said bore and is moveable toward and away from said surface by said piston;

seal means for forming a sliding seal between the thermocouple and the cylinder adjacent one end of said bore to form with said piston a variable volume closed chamber; and means for extending said thermocouple and maintaining it in contact with said surface with a preset force and for retracting the thermocouple through movement of said piston and including fluid supply means for controlling fluid pressure in said closed chamber relative to the pressure acting on the other side of said piston to effect movement of the piston.

2. The apparatus of claim 1 wherein the other side of said piston is exposed to the ambient pressure at the surface of said object, and wherein said closed chamber is formed on the side of said piston remote from said object such that fluid pressure in the closed chamber above said ambient pressure extends said thermocouple and maintains it in contact with said surface with said preset force.

3. The apparatus of claim 2 wherein said fluid supply means selectively lowers the fluid pressure in said closed chamber below said ambient pressure to retract said thermocouple.

4. The apparatus of claim 1 wherein said means for extending said piston includes means for biasing said piston and therefore said thermocouple in one direction against said fluid pressure.

5. The apparatus of claim 4 wherein said biasing means is a spring which biases said thermocouple against said surface with said preset force and wherein fluid under positive pressure selectively supplied by said fluid supply means overcomes said spring bias to retract said thermocouple.

6. The apparatus of claim 1 wherein said object is made of steel and said seal means includes means for forming said seal at the elevated temperatures required for annealing said steel object.

7. In combination, at least two of the apparatus of claim 2 and a common manifold in said fluid supply means for supplying pressurized fluid to the closed chamber of each such apparatus at constant pressure, such that the associated thermocouples are maintained in contact with said apparatus with the same preset constant force.

8. The apparatus of claim 1 wherein said cylinder defines a reduced diameter portion of said bore and wherein said seal means is secured to said thermocouple and forms a sliding seal with said reduced diameter portion of said bore to form said closed chamber.

* * * * *